United States Patent [19]

Villiers

[11] Patent Number: 4,842,537

[45] Date of Patent: Jun. 27, 1989

[54] DEVICE FOR SUPPORTING TWO CONNECTOR ELEMENTS ASSOCIATED RESPECTIVELY WITH TWO BASES WHICH CAN BE REMOVABLY ASSEMBLED TOGETHER AND WHICH ARE LIKELY TO SHOW MUTUAL POSITIONING DISCREPANCIES AND A CONNECTION DEVICE USING SUCH A SUPPORT DEVICE

[75] Inventor: Gérard Villiers, Vanves, France

[73] Assignee: Souriau et Cie, France

[21] Appl. No.: 172,221

[22] Filed: Mar. 23, 1988

[30] Foreign Application Priority Data

Apr. 2, 1987 [FR] France ..... 87 04643

[51] Int. Cl.[4] ..... H01R 13/64

[52] U.S. Cl. ..... 439/246; 439/299; 439/348

[58] Field of Search ..... 439/299, 300, 342, 343, 439/348, 2, 6, 8, 533, 534, 544, 553, 555, 370, 372, 247, 248, 376, 378, 246

[56] References Cited

U.S. PATENT DOCUMENTS

| | | | |
|---|---|---|---|
| 3,094,364 | 6/1963 | Lingg | 439/247 |
| 3,631,377 | 12/1971 | Ball | 439/348 |
| 3,951,500 | 4/1976 | Anderson | 439/248 |
| 4,580,862 | 4/1986 | Johnson | 439/248 |
| 4,647,130 | 3/1987 | Blair et al. | 439/370 |

FOREIGN PATENT DOCUMENTS

| | | | |
|---|---|---|---|
| 0715611 | 1/1942 | Fed. Rep. of Germany | 439/372 |

*Primary Examiner*—David Pirlot

*Attorney, Agent, or Firm*—Larson and Taylor

[57] ABSTRACT

A device is provided for supporting two electric connector elements (3, 11), associated respectively with two bases (1, 9) which can be mechanically assembled together in a removable way, these bases being likely to show mutual positioning discrepancies (shift and/or slant) at the time when they are assembled or separated as well as variable mutual positioning discrepancies (spacing and/or slant) in their assembled position at least in their zones supporting the two connector elements comprising: a first support (2) supporting a connector element (3) and fixed without play on a base (1); a second support (10) supporting the other connector element (11) and fixed to the other base (9) which is movable with respect to the base (1); and mechanical control means (4-8, 12-15) provided on the two supports and adapted for providing automatically correct coupling of the two connector elements and locking of this coupling when the two bases are assembled together, then mechanical separation of the second connector element and the second base so as to allow the breathing movements of the bases and, on the other hand, the uncoupling of the two connector elements at the time of mechanical separation of the two bases.

9 Claims, 3 Drawing Sheets

DEVICE FOR SUPPORTING TWO CONNECTOR ELEMENTS ASSOCIATED RESPECTIVELY WITH TWO BASES WHICH CAN BE REMOVABLY ASSEMBLED TOGETHER AND WHICH ARE LIKELY TO SHOW MUTUAL POSITIONING DISCREPANCIES AND A CONNECTION DEVICE USING SUCH A SUPPORT DEVICE

A device for supporting two connector elements associated respectively with two bases which can be removably assembled together and which are likely to show mutual positioning discrepancies and a connection device using such a support device.

The present invention relates to a device for supporting two connector elements, for example electric connector elements associated respectively with two bases which can be mechanically assembled together in a removable way, these two bases being likely to show mutual positioning discrepancies (shift and/or slant) at the time when they are assembled or separated as well as variable mutual positioning discrepancies (spacing and/or slant) in their assembled position at least in one of their zones supporting the two connector elements (breathing movements of the bases). The invention also relates to a connection device, for example for electrical connection, for establishing connections between two bases which can be assembled mechanically together in a removable way, these two bases being likely to show mutual positioning discrepancies (shift and/or slant) at the time when they are assembled or separated as well as variable mutual positioning discrepancies (spacing and/or slant) in their assembled position.

Although, in the rest of the description, mention will generally be made of an electrical connection, it should however be understood that the invention is not specifically limited to this type of connection and that it relates to all the other connections of the same kind (particularly for example optical connections).

Furthermore, the description mentions the coupling of two connector elements: it should be understood that this number of two is in no wise limitative of the number of components forming each connector element, and simply means that two connecting members and/or groups of connecting members must be couplable together.

The aim of the invention is essentially to provide means making automatic connections possible in difficult circumstances and/or surroundings: lack of space, lack of accessibility, deficiency in positioning the parts to be assembled (lack of positioning reference, positioning tolerances which are greater than those provided for normal coupling of the connector elements), deformation of the assembled parts, etc.

These circumstances are met with in particular in the aviation field, for example for providing electric connections between an aircraft wing and a load supporting mast removably fixed thereto, taking into account the fact that: the electric connections must be formed automatically during positiong and fixing of the mast under the wing; the electric connection members must be situated outside the mechanical fixing members; finally, the wing is subject to very appreciable deformations of its transverse profile during flight (breathing of the wing).

To this end, a first aspect of the invention concerns a support device of the above mentioned kind which is characterized in that it comprises:

a first support supporting a first one of said connector elements and fixed without play on a first one of said bases;

a second support supporting the second connector element and fixed to the second base which is movable with respect to the first base;

and mechanical control means provided on the first and second supports and adapted for providing automatically, on the one hand, correct coupling of the two connector elements and locking of this coupling when the two bases are assembled together, then mechanical separation of the second connector element and the second base so as to allow the breathing movements of the bases and, on the other hand, the uncoupling of the two connector elements at the time of mechanical separation of the two bases.

In a preferred embodiment, the mechanical control means comprise:

means for mutually positioning the two connector elements transversally to their axis, provided on the first and second supports and adapted so that, during assembly of the two bases, said transverse positioning means cooperate mutually so that the second connector element is presented opposite the first connector element and coaxially thereto;

releasable mechanical securing means provided on the second connector element and interposed between the second connector element and the transverse positioning means, and placed under the dependence of said transverse positioning means so as to be able to occupy two functional positions, namely a first functional position in which the transverse positioning means of the first and second supports do not cooperate with each other and the securing means provide rigid rigid mechanical coupling of the second connector element with the second support and a second functional position in which the transverse positioning means cooperate mutually and the securing means no longer provide mechanical coupling of the second connector element to the second support;

means for mounting the second connector element on the second support, these mounting means being adapted so as to allow a movement, more particularly an axial sliding movement, of the second connector element with respect to the second support when said mechanical securing means are in their second functional position;

means for locking the two connector elements in the coupled position, said locking means being adapted so as to occupy a first functional position in which the second connector element is not secured mechanically to the first connector element and may be moved axially with respect thereto (coupling or uncoupling) and a second functional position in which the two connector elements are secured mechanically to each other;

and releasable mechanical connection means interposed between the second support and the second base, these releasable mechanical connection means being placed under the dependence of the means for locking the two connector elements and being adapted so as to be able to occupy two functional positions, namely a first functional position in which said connection means provide an indeformable mechanical connection between the second support and the second base whereas the means for locking the two connector elements are themselves in their first functional position and so that the two connector elements are not locked together, and a second functional position in which said connection means release the second base with respect to the second member whereas the means for locking the two connector elements are themselves in their second functional position and the two connector elements are locked together.

With this arrangement, the coupling together and locking of the two connector elements is achieved entirely automatically when the first and second bases are presented one in front of the other and assembled together, whereas, when the two connector elements are locked together, the mechanical connection between the second support and the second base is suppressed and it is possible for the two bases to undergo relative moving apart and/or slanting movements without the couplign of the two connector elements being affected thereby.

Advantageously, the means for mutually positioning the two connector elements transversally to their axis, include, on the one hand, at least two sets of positioning members with complementary conical projections and conical recesses carried respectively by the first and second supports and, on the other hand, means resiliently deformable in the transverse direction interposed between the second support and the second base.

Preferably, the releasable mechanical securing means interposed between the second connector element and the transverse positioning means include:

at least one rod projecting with respect to the front zone of the second support (10) and substantially parallel to the axis of the second connector element, this rod being adapted for cooperating with a bearing zone of the first support and being movable longitudinally with respect to the second connector element so as to be pushed back by said bearing zone when the transverse positioning means of the first and second supports cooperate;

at least one blocking ball housed partially in a retaining sleeve which surrounds the rod and which has a wall thickness less than the diameter of the ball, and two annular grooves formed respectively in the rod and in the opposite surface of a housing of a second connector element housing the retaining sleeve.

Thus, when the mechanical securing means are in their first functional position, the rod is projecting and holds the ball engaged in the groove of the second connector element, for mechanically coupling the second connector element and the second support and, when the mechanical securing means are in their second functional position the rod is retracted under the thrust exerted by the first support and its groove receives the ball, which frees the second connector element with respect to the second support.

When the preceding arrangements are used at the same time, it is advantageous for the rod to be coaxial to one said conical recess or conical projection provided on the second support and to be housed therein and for the bearing zone of the first support to be formed by a finger which is coaxial to, respectively, a conical projection or conical recess provided opposite on the first support and which projects out of this projection or this recess.

It is also possible for the locking means of the two connector elements to include:

in the second connector element, at least one rod parallel to the axis of the second connector element and movable longitudinally with respect to the second connector element;

at least one blocking ball housed partially in a retaining sleeve surrounding the rod and having a wall thickness less than the diameter of the ball, the retaining sleeve being further secured to the second connector element;

and two annular grooves one of which is formed in the rod and the other of which is formed in the facing surface of a recess provided in an abutment piece of the first connector element and coaxial with the rod.

Thus, when the mechanical coupling means are in their first functional position, the rod is retracted and the ball is pushed back into the groove of the rod, which makes possible coupling of the two connector elements and engagement of the abutment piece of the first connector element about the sleeve of the second connector element and, when the locking means are in their second functional position, the rod is moved axially and the ball is pushed back into the groove of the abutment piece of the firt connector element thus preventing the mechanical separation of the two connector elements.

It is possible to combine, with said locking means, releasable mechanical connection means interposed between the second support and the second base which include:

at least one connecting bodyslidingly surrounding the retaining sleeve and the rod of the locking means for the two connector elements, this connecting body being secured to the second base, at least one blocking ball housed partially in said retaining sleeve which has a wall thickness less than the diameter of the ball, and at least two annular grooves formed respectively in the facing surfaces of the rod and of the connecting body.

Thus, when the mechanical connection means occupy their first functional position, the rod is retracted and the ball is engaged in the groove ofd the connecting body thus mechanically interlocking the base and the second connector element, and, when the connection means occupy their second functional position, the rod is moved axially and the ball is pushed into the groove thereof, mechanically separating the connecting body and the second base and allowing mutual shifts of the first and second bases without affecting the coupling of the two connector elements.

In an embodiment preferred for its structural simplicity, when the two preceding arrangements are used, the rod is a single one and is common to the locking means and to the releasable mechanical connection means and this rod is coaxial with the second connector element.

In this case, it is advantageous for the connecting body to be shaped externally in the form of a sphere portion forming a swivel joint and enclosed in a retaining cross piece fixed to the second base, whereby, when the releasable mechanical connection means are in their second functional position, the first and second bases are further able to undergo slanting movements with respect to each other.

A second aspect of the invention relates to a connection device of the kind mentioned in the preamble which is characterized in that it comprises at least one connector formed of two elements which can be coupled together and a device for supporting said connector element adapted in accordance with the above arrangements.

The invention will be better understood from reading the following detailed description of a preferred embodiment given solely by way of illustrative example; in this description, reference is made to the accompanying drawings in which.

Figure 1:
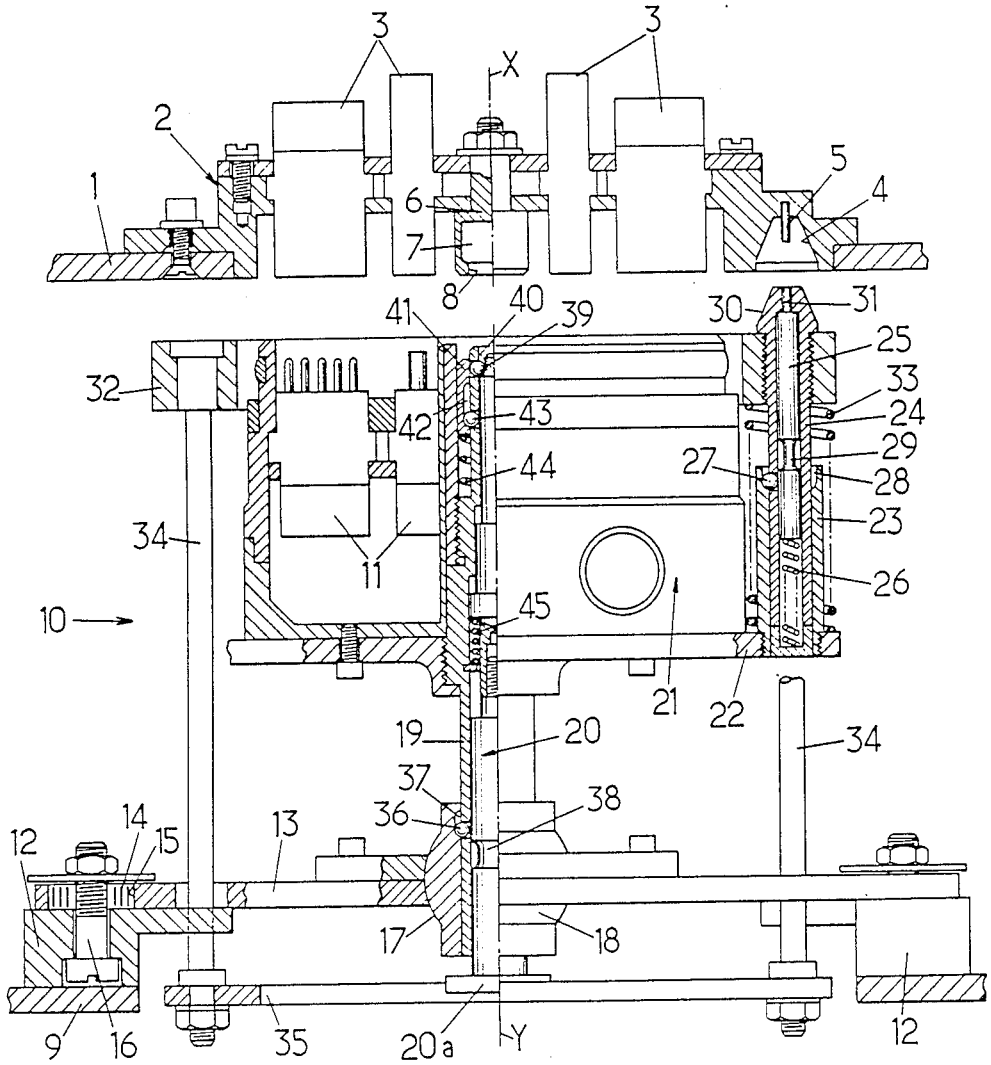
FIG. 1 is a partial sectional view of a connection device formed in accordance with the invention, shown in a first functional position (unconnected position)
Figure 2:
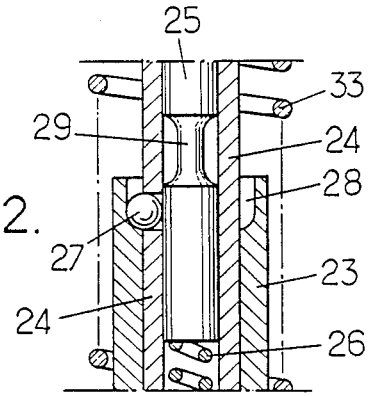
FIGS. 2 to 4 are partial views on a larger scale respectively of three parts of the device of FIG. 1.
Figure 6:
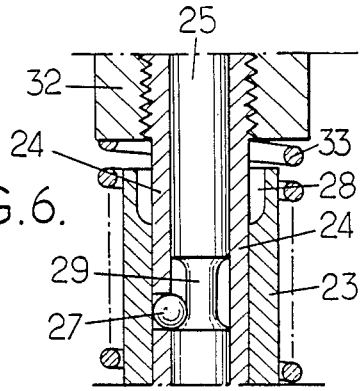
FIGS. 6 to 8 are partial views on a larger scale respectively of three parts of the device of FIG. 5, corresponding to FIGS. 2 to 4 respectively.
Figure 3:
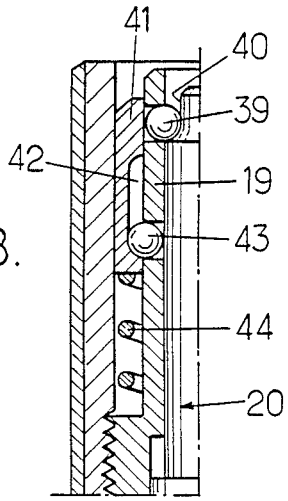
Figure 7:
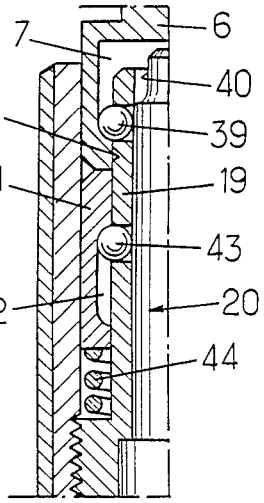
Figure 4:
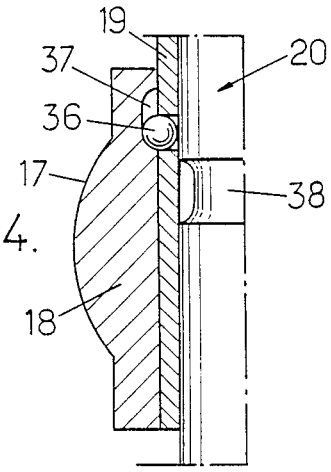
Figure 8:
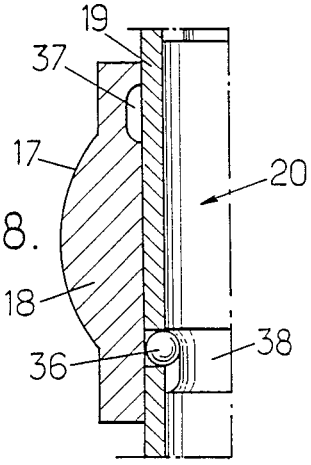
Figure 5:
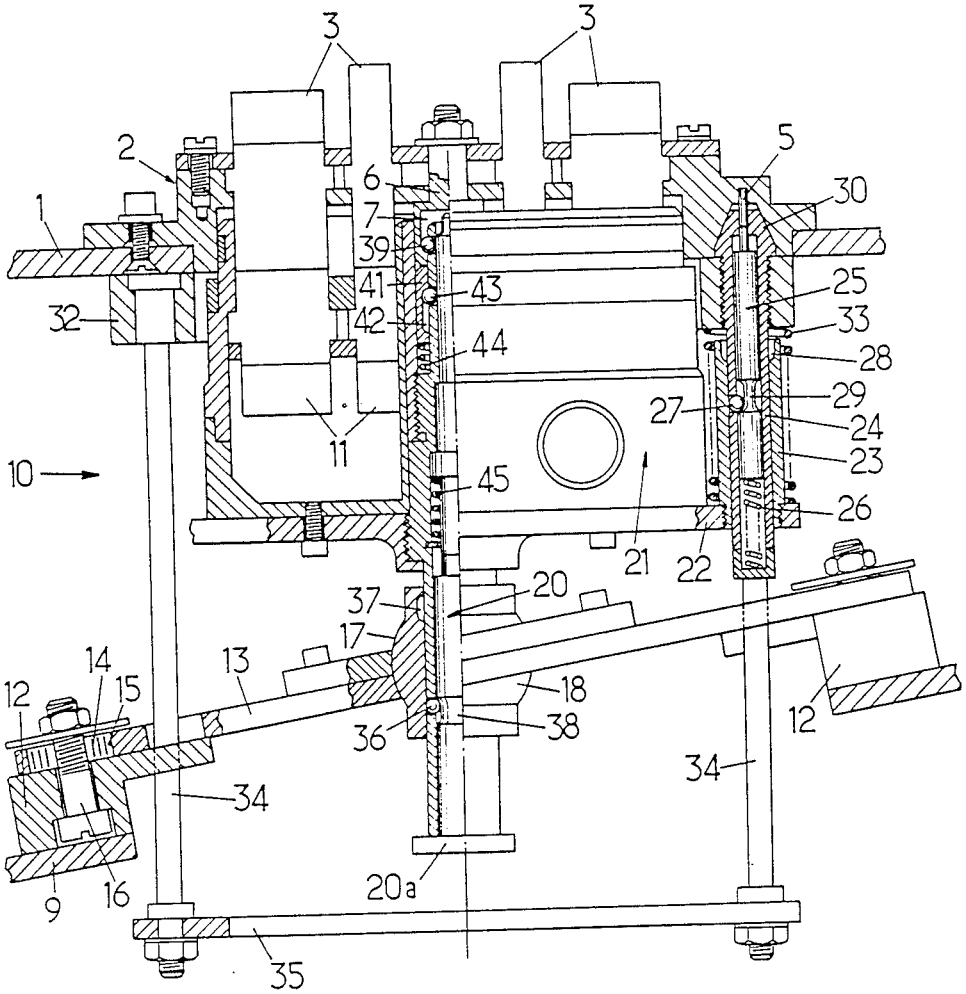
FIG. 5 is a partial sectional view showing the device of FIG. 1 in a second functional position (connected position)

Referring first of all to FIGS. 1 to 4, to a first base 1 is fixed a first support 2 supporting one or more connection members 3. The first support 2 is provided with several (two or three more particularly) conical recesses 4 formed in its front face and at the bottom of each of which projects an axial finger 5.

In the central region of support 2, and preferably coaxially with axis X thereof, there is disposed a retaining piece 6 comprising an axial recess 7 open forwardly through a restriction or neck 8.

Furthermore, to a second base 9 is fixed a second support 10 supporting, by means which will be described hereafter, one or more connection members 11 adapted for cooperating with connection members 3.

The second support 10 comprises a rigid foot 12 fixed (for example screwed) to the second base 9. To foot 12 is fixed a cross piece 13 via resiliently deformable means, such as spiral springs 14. These springs are housed in recesses 15 in cross piece 13 and surround bolts 15 for fixing foot 12 and provide the return of cross piece 13 and foot 12 by surface to surface movement.

Furthermore, the foot 12 is widely recessed in its central region.

The cross piece 13 surrounds, with free swivelling, a spherical surface 17 forming a swivel joint formed by the external surface of a connecting body 18 slidably mounted on the lower part of the sleeve 19 which surrounds, also slidingly, a rod 20 coaxial with the axis Y of the second support 10.

Towards its upper part, sleeve 19 is fixed (for example by screwing) to a casing 21 which surrounds and supports the connecting members 11. A part of casing 21, for example its bottom 22, is in the form of a disk projecting radially from the periphery of the casing. Opposite each of the conical recesses 4 of the first support 2 this disk supports a tubular guide 23, parallel to axis Y, in which a sleeve 24 is slidingly engaged which encloses a sliding rod 25 urged forwardly (upwardly in FIG. 1) by a compression spring 26. Sleeve 24 is pierced radially with one or more holes each containing a ball 27 whose diameter is greater than the wall thickness of sleeve 24. Approximately facing the ball or balls 27, the tubular gucde 23 and rod 25 are provided with grooves, respectively 28 and 29 formed in their faces respectively in contact with the sleeve 24, and adapted for selectively receiving this or these balls 27 (in FIG. 1 ball 27 is engaged in groove 28).

Sleeve 23 extends beyond the front edge of casing 21 and its end is outwardly tapered with a conical tip 30 of a shape complementary to that of the conical recess 4 in the first support 2. An axial bore 31 passes through the conical tip 30 so that finger 5 in the conical recess 4 can coact with the free end of rod 25.

About casing 21 and at a radial distance therefrom is located an annular stop 32 supported by sleeves 24 so that the front annular face of stpo 32 coincides substantially with the front edge of casing 24 and so that the conical tips 30 project from the annular stop 32.

Furthermore, for guiding casing 21 when sliding on rod 20, the annular stop 32 supports guide rods 34 spaced apart over the periphery of stop 32 and passing freely sliding through disk 22 secured to casing 21. In order not to hinder the operation of the device, the free ends of the guide rods 34 extend approximately as far as the level of foot 12 and are held spaced apart from each other by spacers 35.

In its region surrounded by the connecting body 18, sleeve 19 is pierced with one or more holes, each housing a ball 36 having a diameter greater than the wall thickness of sleeve 19. In this zone, the inner surface of the connecting body 18 and the external surface of rod 20 are formed with an annular groove, respectively 37 and 38, dimensioned for receiving this or these balls 36 (in FIG. 1, ball 36 is engaged in groove 37).

Finally, in its portion inside casing 21, sleeve 19 is provided with one or more holes each housing a ball 3 having a diameter greater than the wall thickness of the sleeve. The end of rod 20, situated substantially opposite ball 39, has a reduced diameter forming a recess 40 dimensioned for receiving the ball or balls 39 (as shown in FIG. 1). About sleeve 19 is provided a ring 41 which has a surface bearing on the sleeve adapted for closing the hole housing the ball or balls 39 in its position shown in FIG. 1. This ring is also formed with an annular inner groove 42 coacting with one or more other balls 43 retained by sleeve 19 and serving as stop for the axial movements of ring 41. A compression spring 44, surrounding sleeve 19 and bearing on a shoulder thereof, urges ring 41 into abutment against the ball or balls 43, in the position retaining the ball or balls 39. Finally, a compression spring 45, surrounding rod 20, bears on the respective shoulders of rod 20 and of sleeve 19 so as to tend to urge rod 20 forwards as shown in FIG. 1.

The operation of the device is the following.

In the disconnected position (FIGS. 1 to 4), the balls 27 are engaged in groove 28 of the tubular guide 23 and interlock sleeve 24 with guide 23, and so with casing 21. The balls 39 are engaged in the narrowed portion 40 of rod 20; they prevent this rod from being moved axially forwards and interlock rod 18 with sleeve 19 in this direction. Balls 36 are engaged in groove 37 in the connecting body 18 and interlock sleeve 19 with this body, so with the second base 9.

At the time of assembling the two bases together by their own assembly means (not shown), the two connecting members or sets of connecting members 3 and 11 are presented opposite each other, but their respective axes x and y may be slightly offset with respect to each other even slightly slanted with respect to each other. During this assembly procedure, the cooperation between the conical projections 30 and the conical recesses 4 guide the two assemblies so as to position them accurately one opposite the other so that their respective axes x and y coincide, such positioning being facilitated by the possibility of moving cross piece 13 with respect to foot 12 with deformation of springs 14.

When the conical projections 30 have penetrated fully into the conical recesses 4, fingers 5 push the sliding rods 25 back into sleeves 24 until grooves 29 come opposite the balls 27 which they receive. Casing 21 is then released from sleeves 24 and it is free to slide with respect to support 10 under the thrust action coming from the assembly force of the two bases 1 and 9 and transmitted by the swivel joint 18.

During movement of casing 21 for coupling the connection members 3 and 11, the stop piece 6 pushes ring 41 back against the force of spring 44 until the balls 39 come opposite the recess 7 in which, urged by rod 20, they are engaged. With rod 20 thus released, it slides in sleeve 19 and blocks balls 39 in recess 7, thus providing mechanical locking of the coupling of the two connection members 3 and 11.

During sliding of rod 20, the groove 38 thereof has come opposite the balls 36 which it receives and the connecting body 18 is released with respect to the sleeve. The cross piece 13, and so base 9, are free to move away and/or to pivot with respect to base 1.

The disconnection is caused by a tractive force exerted on base 9 for moving it away from base 2, which force is transmitted by the swivel joint 17 to the connecting body 18; this latter sides over sleeve 19 until it abuts head 20 of rod 20, in which position groove 37 is opposite balls 36; continuing its sliding movement, the connecting body 18 drives rod 20, which results in pushing balls 36 back into groove 37 (because of the elongate shape thereof) and brings the endmost recess 40 of rod 20 opposite balls 39 which are pushed back therein under the action of ring 41 subjected to the force of spring 44; rod 20 is thus separated mechanically from sleeve 19. There then follows unlocking of the connection, mutual separation of the connecting members 3 and 11, locking of rod 20 in the retracted position inside the sleeve and return of rods 25 to the initial position.

As is evident and as it follows moreover already from what has gone before the invention is in no way limited to those of its modes of application and embodiments which have more especially considered; it embraces on the contrary, all variants thereof.

I claim:

1. A device for supporting two connector elements such as electric connector elements, associated respectively with two bases which can be mechanically and removably assembled together, these two bases being likely to show mutual positioning discrepancies when assembled or separated, as well as variable mutual positioning discrepancies in their assembled position at least in places which support the two connector elements, characterized in that it comprises:

(i) a first support supporting a first one of said connector elements and fixed without play on a first one of said bases;

(ii) a second support supporting a second connector element and fixed to a second base which is movable with respect to the first base;

(iii) and mechanical control means provided on the first and second supports and comprising:

transverse positioning means provided on the first and second supports for mutually positioning the two connector elements transversely relative to their axis, so that, during assembly of the two bases, the second connector element is presented opposite the first connector element and coaxially thereto;

releasable mechanical securing means provided on the second connector element and interposed between the second connector element and the transverse positioning means, and placed under the dependence of said transverse positioning means so as to be able to occupy two functional positions, namely a first functional position in which the transverse positioning means does not function to effect transverse positioning and the securing means provide rigid mechanical coupling of the second connector element with the second support, and a second functional position in which the transverse positioning means does function to effect transverse positioning and the securing means no longer provide mechanical coupling of the second connector element to the second support;

mounting means for mounting the second connector element on the second support, said mounting means being adapted so as to allow a movement of the second connector element with respect to the second support when said mechanical securing means are in their second functional position;

locking means for locking the two connector elements in the coupled position, said locking means being adapted so as to occupy a first functional position in which the second connector element is not secured mechanically to the first connector element and may be moved axially with respect thereto and a second functional position in which the two connector elements are secured mechanically to each other;

and releasable mechanical connection means interposed between the second support and the second base, said releasable mechanical connection means being placed under the dependence of the locking means and being adapted so as to be able to occupy two functional positions, namely a first functional position in which said connection means provide an indeformable mechanical connection between the second support and the second base, wherein the means for locking the two connector elements are themselves in their first functional position and so that the two connector elements are not lock together, and a second functional position in which said connection means release the second base with respect to the second member, wherein the means for locking the two connector elements are themselves in their second functional position and the two connector elements are locked together.

whereby the coupling together and locking of the two connector elements is achieved entirely automatically when the first and second bases are presented one in front of the other and assembled together, wherein, when the two connector elements are locked together, the mechanical connection between the second support and the second base is suppressed and it is possible for the two bases to undergo relative movement without the coupling of the two connector elements being affected thereby.

2. Device according to claim 1, characterized in that the means (4, 30, 12–16) for mutually positioning the two connector elements transversally to their axis, include, on the one hand, at least two sets of positioning members with complementary conical projections (30) and conical recesses (4) carried respectively by the first (2) and second (10) supports and, on the other hand, means (14) resiliently deformable in the transverse direction interposed between the second support and the second base.

3. Device according to claim 1, characterized in that the releasable mechanical securing means (5, 23–29, 31) interposed between the second connector element and the transverse positioning means include:

at least one rod (25) projecting with respect to the front zone of the second support (10) and substantially parallel to the axis of the second connector element, this rod being adapted for cooperating with a bearing zone of the first support (2) and being movable longitudinally with respect to the second connector element so as to be pushed back by said bearing zone when the transverse positioning means of the first and second supports cooperate;

at least one blocking ball (27) housed partially in a retaining sleeve (24) which surrounds the rod and which has a wall thickness less than the diameter of the ball, and two annular grooves (29, 28) formed respectively in the rod (25) and in the opposite surface of a housing of a second connector element housing the retaining sleeve whereby when the mechanical securing means are in their first functional position, the rod is projecting and holds the ball engaged in the groove of the second connector element, for mechanically coupling the second connector element and the second support and, when the mechanical securing means are in their second functional position the rod is retracted under the thrust exerted by the first support and its groove receives the ball, which frees the second connector element with respect to the second support.

4. Device according to claim 1, characterized in that the means (4, 30, 12–16) for mutually positioning the two connector elements transversally to their axis, include, on the one hand, at least two sets of positioning members with complementary conical projections (30) and conical recesses (4) carried respectively by the first (2) and second (10) supports and, on the other hand, means (14) resiliently deformable in the transverse direction interposed between the second support and the second base, in that the releasable mechanical securing means (5, 23–29, 31) interposed between the second connector element and the transverse positioning means include:

at least one rod (25) projecting with respect to the front zone of the second support (10) and substantially parallel to the axis of the second connector element, this rod being adapted for cooperating with a bearing zone of the first support (2) and being movable longitudinally with respect to the second connector element so as to be pushed back by said bearing zone when the transverse positioning means of the first and second supports cooperate;

at least one blocking ball (27) housed partially in a retaining sleeve (24) which surrounds the rod and which has a wall thickness less than the diameter of the ball.

and two annular grooves (29, 28) formed respectively in the rod (25) and in the opposite surface of a housing of a second connector element housing the retaining sleeve whereby when the mechanical securing means are in their first functional position, the rod is projecting and holds the ball engaged in the groove of the second connector element, for mechanically coupling the second connector element and the second support and, when the mechanical securing means are in their second functional position the rod is retracted under the thrust exerted by the first support and its groove receives the ball, which frees the second connector element with respect to the second support, and that the rod (25) is coaxial to one said conical recess or conical projection (30) provided on the second support and is housed therein and in that the bearing zone of the first support is formed by a finger (5) which is coaxial to, respectively, a conical projection or conical recess (4) provided opposite on the first support and which projects out of this projection or this recess.

5. Device according to claim 1, characterized in that the locking means (6–8, 19–20, 39–45) of the two connector elements include:

in the second connector element, at least one rod (20) parallel to the axis (y) of the second connector element and movable longitudinally with respect to the second connector element;

at least one blocking ball (39) housed partially in a retaining sleeve (19) surrounding the rod and having a wall thickness less then the diameter of the ball, the retaining sleeve (19) being further secured to the second connector element;

and two annular grooves one of which (40) is formed in the rod and the other of which is formed in the surface of a recess (7) provided in an abutment piece (6) of the first connector element and coaxial with the rod whereby when the locking means are in their first functional position, the rod is retracted and the ball is pushed back into the groove of the rod, which makes possible coupling of the two connector elements and engagement of the abutment piece of the first connector element about the sleeve of the second connector element and, when the locking means are in their second functional position, the rod is moved axially and the ball is pushed back into the groove of the abutment piece of the first connector element thus preventing the mechanical separation of the two connector elements.

6. Device according to claim 1, characterized in that the locking means (6–8, 19–20, 39–45) of the two connector elements include:

in the second connector element, at least one rod (20) parallel to the axis (y) of the second connector element and movable longitudinally with respect to the second connector element;

at least one blocking ball (39) housed partially in a retaining sleeve (19) surrounding the rod and having a wall thickness less than the diameter of the ball, the retaining sleeve (19) being further secured to the second connector element;

and two annular grooves one of which (40) is formed in the rod and the other of which is formed in the surface of a recess (7) provided in an abutment piece (6) of the first connector element and coaxial with the rod whereby when the locking means are in their first functional position, the rod is retracted and the ball is pushed back into the groove of the rod, which makes possible coupling of the two connector elements and engagement of the abutment piece of the first connector element about the sleeve of the second connector element and, when the locking means are in their second functional position, the rod is moved axially and the ball is pushed back into the groove of the abutment piece of the first connector element thus preventing the mechanical separation of the two connector elements, and in that the releasable mechanical connection means (17–20, 36–38) interposed between the second support and the second base which include:

at least one connecting body (18) slidingly surrounding the retaining sleeve (19) and the rod (20) of the locking means (6–8, 19–20, 39–45) for the two connector elements, this connecting body being secured to the second base, at least one blocking ball (36) housed partially in said retaining sleeve which has a wall thickness less than the diameter of the ball, and at least two annular grooves (38, 37) formed respectively in the facing surfaces of the rod (20) and of the connecting body (19), whereby when the mechanical connection means occupy their first functional position, the rod is retracted and the ball is engaged in the groove of the connecting body thus mechanically interlocking the base and the second connector element, and, when the connection means occupy their second functional position, the rod is moved axially and the ball is pushed into the groove thereof, mechanically separating the connecting body and the second base and allowing mutual shifts of the first and second bases without affecting the coupling of the two connector elements.

7. Device according to claim 1, characterized in that the locking means (6–8, 19–20, 39–45) of the two connector elements include:

in the second connector element, at least one rod (20) parallel to the axis (y) of the second connector element and movable longitudinally with respect to the second connector element;

at least one blocking ball (39) housed partially in a retaining sleeve (19) surrounding the rod and having a wall thickness less than the diameter of the ball, the retaining sleeve (19) being further secured to the second connector element;

and two annular grooves one of which (40) is formed in the rod and the other of which is formed in the surface of a recess (7) provided in an abutment piece (6) of the first connector element and coaxial with the rod whereby when the locking means are in their first functional position, the rod is retracted and the ball is pushed back into the groove of the rod, which makes possible coupling of the two connector elements and engagement of the abutment piece of the first connector element about the sleeve of the second connector element and, when the locking means are in their second functional position, the rod is moved axially and the ball is pushed back into the groove of the abutment piece of the first connector element thus preventing the mechanical separation of the two connector elements, and in that the releasable mechanical connector means (17–20, 36–38) interposed between the second support and the second base which include:

at least one connecting body (18) slidingly surrounding the retaining sleeve (19) and the rod (20) of the locking means (6–8, 19–20, 39–45) for the two connector elements, this connecting body being secured to the second base, at least one blocking ball (36) housed partially in said retaining sleeve which has a wall thickness less than the diameter of the ball, and at least two annular grooves (38, 37) formed respectively in the facing surfaces of the rod (20) and of the connecting body (19), whereby when the mechanical connection means occupy their first functional position, the rod is retracted and the ball is engaged in the groove of the connecting body thus mechanically interlocking the base and the second connector element, and, when the connection means occupy their second functional position, the rod is moved axially and the ball is pushed into the groove thereof, mechanically separating the connecting body and the second base and allowing mutual shifts of the first and second bases without affecting the coupling of the two connector elements, and in that the rod (20) is single and coaxial with the second connector element.

8. Device according to claim 1, characterized in that the locking means (6–8, 19–20, 39–45) of the two connector elements include:

in the second connector element, at least one rod (20) parallel to the axis (y) of the second connector element and movable longitudinally with respect to the second connector element;

at least one blocking ball (39) housed partially in a retaining sleeve (19) surrounding the rod and having a wall thickness less than the diameter of the ball, the retaining sleeve (19) being further secured to the second connector element;

and two annular grooves one of which (40) is formed in the rod and the other of which is formed in the surface of a recess (7) provided in an abutment piece (6) of the first connector element and coaxial with the rod whereby when the locking means are in their first functional position, the rod is retracted and the ball is pushed back into the groove of the rod, which makes possible coupling of the two connector elements and engagement of the abutment piece of the first connector element about the sleeve of the second connector element and, when the locking means are in their second functional position, the rod is moved axially and the ball is pushed back into the groove of the abutment piece of the first connector element thus preventing the mechanical separation of the two connector elements, and in that the releasable mechanical connection means (17–20, 36–38) interposed between the second support and the second base which include:

at least one connecting body (18) slidingly surrounding the retaining sleeve (19) and the rod (20) of the locking means (6–8, 19–20, 39–45) for the two connector elements, this connecting body being secured to the second base, at least one blocking ball (36) housed partially in said retaining sleeve which has a wall thickness less than the diameter of the ball, and at least two annular grooves (38, 37) formed respectively in the facing surfaces of the rod (20) and of the connecting body (19), whereby when the mechanical connection means occupy their first functional position, the rod is retracted and the ball is engaged in the groove of the connecting body thus mechanically interlocking the base and the second connector element, and, when the connection means occupy their second functional position, the rod is moved axially and the ball is pushed into the groove thereof, mechanically separating the connecting body and the second base and allowing mutual shifts of the first and second bases without affecting the coupling of the two connector elements, and in that the rod (20) is single and coaxial with the second connector element, and in that the connecting body (18) is shaped externally in the form of a sphere portion forming a swivel joint (17) and enclosed in a retaining cross piece (13) fixed to the second base (9), whereby, when the releasable mechanical connection means are in their second functional position, the first and second bases are further able to undergo slanting movements with respect to each other.

9. Connection device, for example for electric connection, for providing connections between two bases (1, 9) which can be mechanically assembled together in a detachable way, these two bases being likely to show discrepancies of mutual positioning (shift and/or slant) at the time of their assembly or separation as well as variable mutual positioning discrepancies (spacing and/or slant) in their assembled position, characterized in that it comprises at least one connector formed of two elements (3, 11) which can be coupled together and a device (2, 4–8, 10) for supporting said connector elements adapted in accordance with claim 1.

* * * * *